US005575900A

United States Patent [19]

Antelman et al.

[11] Patent Number: 5,575,900

[45] Date of Patent: Nov. 19, 1996

[54] GOLD PLATING SOLUTIONS

[75] Inventors: Marvin S. Antelman, Rehovot, Israel; Perry W. Antelman, Providence, R.I.

[73] Assignees: Antelman Technologies Ltd., Providence; Tivian Industries, Ltd., East Providence, both of R.I.

[21] Appl. No.: 497,907

[22] Filed: Jul. 3, 1995

[51] Int. Cl.[6] ..... C25D 3/48

[52] U.S. Cl. ..... 205/267; 205/268

[58] Field of Search ..... 205/247, 248, 205/249, 250, 251, 266, 267, 268; 106/1.14, 1.18, 1.23, 1.26

[56] References Cited

U.S. PATENT DOCUMENTS 2,905,601 9/1959 Rinker et al. ..... 204/43
3,149,057 9/1964 Parker et al. ..... 205/268
3,475,292 10/1969 Shoushanian ..... 205/248

*Primary Examiner*—Donald R. Valentine
*Assistant Examiner*—Edna Wong
*Attorney, Agent, or Firm*—Salter & Michaelson

[57] ABSTRACT

Opportunistic decorative mass production gold plating solutions are described which are capable of plating gold at concentrations as low as one-half pennyweight per gallon based on an alkaline gold cyanide complex. The low concentration enables ecological operations as well as low working capital inventory operations. The solutions feature high efficiency "put through" replenishment of gold, and non 24 Karat gold deposition capabilities such as 18 and 14 Karats without the necessity of adding metal salts. The solutions operate over a pH range of one to seven without affecting the stability of the gold cyanide complex in the pH range of 1–2.5. A preferred embodiment of the invention comprises an electrolyte mixture of three buffer salts and two chelating agents capable of depositing bright hard 18 Karat gold colored deposits.

7 Claims, No Drawings

GOLD PLATING SOLUTIONS

BACKGROUND OF THE INVENTION

The present invention relates to commercial mass production electroplating of gold and more particularly to decorative gold plating solutions utilized in said production.

Decorative gold electroplating came into vogue at first in France during the 19th Century pursuant to the discovery by Glassford Napier (*Philosophical Magazine* 25, 61 (1844)) that gold dissolves anodically in potassium cyanide to give $KAu(CN)_2$, which assays approximately 68% Au. That salt is called potassium gold cyanide, or by those skilled in the art, simply PGC. PGC was the solid utilized in the first electroplating solutions. They were extremely toxic, containing large quantities of alkaline cyanides to foster conductivity and stability. The deposits were rich 24 karat gold. Gold concentrations were about one to two troy ounces per gallon of gold. Subsequently it was discovered that by adding various metal cyanide salts to the solution, various colors could be achieved. For example, 18 and 14 karat colors were obtained by adding nickel cyanide at various concentrations, and Vermeil green gold by adding silver cyanide.

As time progressed, the huge concentrations of cyanides were diminished as it was learned that various mixtures of alkali phosphates, carbonates and hydroxides could partially replace the cyanides. PGC was sometimes replaced with the sodium gold salt. Nevertheless, the current state of the art prefers PGC. This is exemplified by the current *Metal Finishing Guidebook Directory* for 1995. It suggests gold concentrations in alkaline solutions should vary between one to one and a half troy ounces per gallon and contain 240–400 g. of potassium cyanide per gallon for bright gold deposits. Such a solution requires a minimum inventory for a ten gallon bath at all times of approximately $4,000 based on current gold prices. The bath is highly toxic and can only be operated in conformity with environmental statutes with special cyanide waste treating systems. On the other hand, Robert Duva and Edwin Rinker, invented acid gold electroplating solutions, exploiting the fact that PGC is a highly stable gold complex and can exist at pH values in the presence of Citric acid as low as 2.5, but recommended commercial baths closer to 4.0 for which they were awarded U.S. Pat. No. 2,905,601 in 1959. These solutions were used extensively in decorative plating and required less gold. At the time they were introduced by the patent assignee, Sel Rex Corporation, gold was selling at $35 an ounce, so that a ten gallon bath at the time would require about $400 of PGC at an Au concentration of one troy ounce per gallon compared to today's aforementioned cost of $4,000. With the rise of gold costs and the financial pressures for reduced inventories, it was found that the Citric acid baths could be sustained in production at operational concentrations of four pennyweights of gold per gallon. Nevertheless, in mass production involving opportunistic production contractors and mass producers of decorative goods, such as costume jewelry, where 100 gallon baths are the rule and not the exception, this would translate into $8,000 of inventory per 100 gallon bath.

When both types, the alkaline and acid gold solutions are employed for decorative plating, there reaches a point where the solutions are contaminated and must be discarded. The residual gold in the solution is refined for recovery, but at a fixed loss. New electrolytes must now be purchased for restarting the bath. Accordingly, these baths have a "put through" limit, that is—how many ounces of PGC can be put through the bath as gold is consumed until the bath is exhausted for replenishment. The salts utilized for the acid baths are more expensive and somewhat proprietary compared to those for the alkaline baths. The acid baths can also be utilized at neutral pH's. The acid type golds are harder than the alkaline, which are soft. Unlike the aforementioned state of the art, in opportunistic plating, one tries to achieve the maximum specification of gold at the least operating and inventory maintenance costs. This includes a minimum deposit of gold, called a flash deposit, where only appearance is required, a minimum soft gold deposit from an alkaline gold solution. On the other hand, if one wants durability, the more expensive acid type bath is used for flash deposits. Now both types of solutions require metal salt additions to achieve various colors other than 24 kt. gold and concentration maintenance. The solutions also must be chemically adjusted for production runs of both racked and barrel plated goods.

From the aforesaid factors one can define the goals of an effective and opportunistic gold electroplating solution, the subject of this invention, as follows:

1. Ecological
2. Low gold concentration
3. Maximum "put through"
4. Durability of gold deposit
5. Metal salt-free non-24 karat color maintenance Following these goal guidelines, the first two goals were addressed. The rationale was to develop a plating solution without free cyanide. Accordingly, the only cyanide was to be complexed cyanide of PGC. The next goal was to achieve a minimum operating Au concentration never before achieved in mass production plating, i.e. one-half pennyweight per gallon. This was achieved. Thereafter, the goal of a "put through" of 20 times (20×) that concentration was attempted and was achieved. Accordingly, the total amount of gold added to the bath over its life was ten pennyweights or one-half troy ounce per gallon. The residual CN concentration was no greater than 500 PPM. After these achievements, pH adjustments of sundry prototype solutions, led to a variety of flash golds with exceptional durability. Finally a wide range of colors was achieved with these solutions ranging from rich 24 karat to light 18 and 14 karat colors dependent on a wide parameter voltage-temperature variability grid. All of these achievements were done on a laboratory scale utilizing beakers and Hull cells, with platinum clad anodes. Thereafter, the best solutions were evaluated in five and ten gallon sections of a compact mini production plating console. After achieving success, a two-year actual production research and development program was undertaken with various mass production gold electroplaters in the Providence, R.I./Attleboro, Mass. area, known as a major center for decorative goods production. It was under these actual production conditions where the baths were tested and perfected for particular results. It was found invariably that the "put through" life of a particular plating bath was substrate as well as chemical dependent.

The final PGC gold functional electrolytes described in this invention were based on the following three types of ingredients: a primary buffer, salt of acetic acid and/or an alpha hydroxy $C_nH_n$ derivative salt; and in some cases a secondary buffer, i.e. an alkaline phosphate; and in some cases a chelating agent.

OBJECTS OF THE INVENTION

The main object of this invention is to achieve electroplating solutions for mass production decorative gold plating which are opportunistic, i.e. produce the widest variety of desirable functional properties and colors at minimal cost. Among the other objects of the invention are the individual functional properties.

Thus another object of the invention is to provide an ecological decorative opportunistic mass production gold plating solution.

Still another object of this invention is to provide said plating solution with a minimum operating concentration capability of gold as low as one-half pennyweight of gold per gallon of solution.

Still another object of the invention is to enable said plating solution to achieve maximum "put throughs" of at least 20 times the original concentration of gold in the bath via PGC replenishment.

Still another object of the invention is to enable said solution to deposit durable hard gold deposits.

Still another object of the invention is to enable said solution to deposit gold colors other then 24 karat, e.g. 18 and 14 karat, without the addition of sundry metal salts to said solution and to rely instead on wide operating parameters of voltage and/or temperature variables to achieve said colors.

Other objects, features and advantages of the invention shall become apparent as the description thereof proceeds herein.

SUMMARY OF THE INVENTION

The opportunistic gold plating solutions which are the subject of this invention are capable of achieving the five heretofore described operational objectives.

The solutions' optimum PGC concentrations vary from one-half to one pennyweight per gallon. All the solutions contain a primary buffer system which is based on acetic acid and/or alpha hydroxy derivatives of acetic acid.

Thus the primary buffer conforms to the following molecular configuration:

$$RCH_2COOX$$

where R can be either H, OH, $OHCH_2$ or analogous structures on a longer aliphatic chain. Thus acetic, hydroxyacetic, and lactic acid all conform to the configuration. X can be H or a monovalent alkaline metal such as Na or K. One can also define the primary buffer as either acetic acid and/or an alpha hydroxy $C_nH_n$ derivative of acetic acid. When n=0 for C and H, hydroxyacetic acid is represented. Accordingly, the preferred embodiments of the primary buffer salt in order of descending efficacy are:

1. Hydroxyacetic acid and acetic acid mixture
2. Hydroxyacetic acid
3. Acetic acid The buffer salts can be prepared by mixing salts and free acids or neutralizing the free acid involved. For example, primary buffer electrolyte has been made from a mixture of hydroxyacetic acid and its potassium salt or by neutralizing a mixture of acetic and hydroxyacetic acid with free alkali to the desired buffer pH. The pH can vary from one to seven. Hydroxyacetic acid alone has been found to stabilize the PGC complex at pH values below 2.5 which was not contemplated by the aforementioned expired patent of Robert Duva and Edwin Rinker.

The secondary buffer when used is phosphoric acid, and is most often employed as either the monopotassium or dipotassium hydrogen phosphate salt. Furthermore, the latter salt has been mixed with primary buffer free acid which produces a mixture of buffer phosphate and acid salts. The converse has also been employed where the basic potassium hydroxyacetate salt, for example, has been neutralized to a lower pH with phosphoric acid forming a potassium acid phosphate whose stoichiometry is determined by pH.

The chelating agent is the third main ingredient of the electrolyte. While it is preferred, it is not a necessity. Most of the baths do contain a chelating agent. Its function is to control crystalline integrity of the gold deposit and variable parameters for producing gold colors other than a 24 karat color. However, the nature of the chelating agent is important to prevent secondary reactions initiated by reducing metal substrates such as zinc, from shortening the life of the bath and depositing colloidal gold in the solution. Thus while EDTA gives the best color and crystal control, it accelerates zinc or steel initiated bath decomposition.

HEEDTA can give good results with steel substrates with stricter parameter controls to give deposits equivalent to EDTA. However, less noble zinc such as brass, or zinc substrates which have porous preplate finishes, begin to decompose the HEEDTA bath necessitating the less aggressive NTA which however, puts further parametric restrictions on the bath to obtain bright colors and increased "put through" as well as other unique properties.

It should be pointed out that some of the opportunistic properties of said gold plating baths are synergistic. For example, cyanide gold baths have very long "put through" lives, far exceeding the "put throughs" achieved by this invention. However, the present state of the art knows of no low inventory gold bath at one-half pennyweight ounces per gallon which can have a minimum 20 times (20×) "put through". The one-half pennyweight concentration represents an inventory of $1,000 on a 100 gallon mass production bath as opposed to the aforementioned $8,000 continuous investment for an efficient four pennyweight per gallon acid gold solution. The highest "put through" achieved has been 5.0 troy ounces of gold per gallon in a 50 gallon bath, representing a "put through" of 200 times. Ecologically this bath has a maximum CN concentration at 200 times of 5,000 PPM or 0.5% CN. Amazingly, said bath with a 40 times "put through" could theoretically be disposed of directly, without CN treatments, in districts allowing 1000 PPM CN.

The durability of finishes from said opportunistic baths of the instant invention was evaluated by abrasion and similar tests and found to be superior to soft gold deposits. Various gold colors were achieved by changing the voltage and/or the temperature of a bath. Correlation of formulations was done to allow for a maximum temperature or voltage range for a particular color. Thus a 10 degrees Fahrenheit spread to maintain a color integrity was preferred over solutions which changed color at a constant voltage over a two degree range. Conversely, this was done with voltage settings at constant temperature. While these solutions enabled a wide variety of 14–24 karat colors without metal salt additions, other colors were obtained by adding metal salts such as nickel, indium, silver and cobalt.

Other objects and features of the present invention will become apparent to those skilled in the art when the present invention is considered in view of the accompanying examples. It should of course be recognized that the accompanying examples illustrate preferred embodiments of the present invention and are not intended as a means of defining the limits and scope of the present invention.

EXAMPLE 1

Ten gallons of gold plating solution containing 5.8 lbs. of commercial grade liquid 70% hydroxyacetic acid, 8.25 lbs. of solid potassium hydroxyacetate and 0.84 lbs. of disodium EDTA was formulated. The solution was maintained at one-half pennyweight of gold per gallon with PGC, as were all the gold baths described in this and other examples. It plated 18 karat gold bright deposits at room temperature with a "put through" of 20 times utilizing racks of nickel plated jewelry. The final cyanide assay was approximately 1000 PM whose origin was solely from PGC. The pH of the bath was maintained between four and five. The bath conformed to all the aforementioned five opportunistic parameters.

EXAMPLE 2

A 50 gallon tank containing potassium hydroxyacetate buffer in the proportions described in Example 1 and EDTA was operated with gold at one-half pennyweight per gallon. The pH was maintained between three and five and the temperature at 130° F. with constant filtering and agitation. The conductivity of the bath was maintained by adding ten lbs. dipotassium phosphate, and maintaining this level of conductivity by periodic additions of the phosphate and acetic acid. This bath was used for five months in production with a "put through" achieved of five troy ounces per gallon equivalent to 200 times. Substrates utilized were white metal, lead and steel which had been thickly precopper plated followed by nickel.

EXAMPLE 3

A 40 gallon bath was made up containing the same ratio of buffer and EDTA as described in Example 1. It was operated at one-half to one pennyweight per gallon of gold. The substrates, which were being plated in barrels, were only flash plated. The bath began to deteriorate with the precipitation of colloidal purple gold particles. The bath was then adjusted with HEEDTA which corrected the problem.

EXAMPLE 4

A five gallon bath was made up containing one gallon of 70% hydroxyacetic acid and potassium hydroxide to give a final pH equal to one. PGC was added to maintain a concentration of one pennyweight of gold per gallon. Racked gold plated substrates were plated with a very hard rich 24 karat gold to thicknesses of 10 millionths of an inch.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within the metes and bounds of the claims or that form their functional as well as conjointly cooperative equivalents, are therefore intended to be embraced by these claims.

What is claimed:

1. A plating bath electrolyte for the large scale mass production decorative electroplating of gold comprising:

a) a soluble alkali complex gold cyanide salt wherein the gold concentration is in the range of 0.5 to 1.0 pennyweights per gallon;

b) a primary buffer salt in the pH range from one to seven having the molecular structure $RCH_2COOX$, where R is either H, OH, $OHCH_2$ or alpha hydroxy structure analogous to the latter, and where X is either H, Na or K; and c) a secondary buffer of a phosphoric acid soluble salt.

2. The plating bath electrolyte of claim 1 further comprising a chelating agent.

3. The plating bath electrolyte of claim 1 wherein the gold concentration is as low as one-half pennyweight per gallon.

4. The plating bath electrolyte of claim 1 further comprising hydroxyacetic acid.

5. The plating bath electrolyte of claim 4 wherein the pH range is 1–3, which enables the bath to produce hard gold deposits.

6. The plating bath electrolyte of claim 1, wherein gold additions can be made at least twenty times to maintain the same gold concentration.

7. The plating bath electrolyte of claim 1 wherein no metal salt addition is required to achieve decorative colors other than 24 karat gold.

* * * * *